United States Patent [19]

Marko et al.

[11] Patent Number: 4,629,228

[45] Date of Patent: Dec. 16, 1986

[54] PUSH-PULL DOOR LATCH

[75] Inventors: Neil L. Marko, Birmingham, Mich.; Bruce W. Mitton, Fayette, Ohio

[73] Assignee: Universal Industrial Products Co. (Div. of Core Industries, Inc.), Pioneer, Ohio

[21] Appl. No.: 798,330

[22] Filed: Nov. 15, 1985

[51] Int. Cl.[4] ..... E05C 1/12

[52] U.S. Cl. ..... 292/165; 292/173; 292/169.18

[58] Field of Search ..... 292/165, 166, 173, 169.17, 292/169.18, 174

[56] References Cited

U.S. PATENT DOCUMENTS

| | | | |
|---|---|---|---|
| 3,264,025 | 8/1966 | Hawes | 292/166 |
| 3,518,854 | 7/1970 | Krantz | 292/166 X |
| 3,655,230 | 4/1972 | Armstrong | 292/169 |
| 3,865,414 | 2/1975 | Schlage | 292/165 X |
| 4,101,153 | 7/1978 | Dozier | 292/165 X |
| 4,305,609 | 12/1981 | Klay | 292/169.17 |
| 4,387,917 | 6/1983 | Cocker | 292/93 X |

FOREIGN PATENT DOCUMENTS

| | | | |
|---|---|---|---|
| 1016976 | 9/1977 | Canada | 292/165 |

*Primary Examiner*—Carl D. Friedman

*Attorney, Agent, or Firm*—Harness, Dickey & Pierce

[57] ABSTRACT

A push-pull door latch having a pivotally secured handle and handle support operative for rotating a cam member via a pinion member in response to pivotal motion of an elongated leg on the handle support and the engagement of a driver tab on the elongated leg with the pinion member, and with the rotational motion of the cam member driving a slide member in translation, with the slide member connected with a bolt of a bolt assembly and with the translational movement of the slide member moving the bolt to a latched or unlatched position and with the slide member moving the bolt to its unlatched position in response to pivotal motion of the elongated leg by either pushing or pulling on the handle.

14 Claims, 4 Drawing Figures

PUSH-PULL DOOR LATCH

SUMMARY BACKGROUND OF THE INVENTION

The present invention relates to a door latch and more particularly to a mechanism operable by either pulling or pushing on an associated pivoted arm or handle.

Door latches are most commonly constructed to be actuated by a knob or handle which is rotated in a plane parallel to the plane of the door. In many applications, however, it is desirable to have a door latch that would be operable by a pulling or pushing force applied to a handle; in the latter case the handle is supported for pivotal movement towards or away from the plane of the door. Such structures are generally shown in the U.S. Pat. No. 3,655,230 issued Apr. 11, 1972 to Armstrong, U.S. Pat. No. 4,305,609 issued Dec. 15, 1981 to Klay, and U.S. Pat. No. 4,387,917 issued June 14, 1983 to Cocker.

With the unique door latch of the present invention, the handle can be operated in pull or push mode from either side of the door; in addition, the handle can be selectively oriented to extend either vertically or horizontally. The mechanism itself is of a simple construction lending itself to fabrication substantially from stamped sheet metal parts.

Therefore it is an object of the present invention to provide a unique door latch construction operable by either pulling or pushing a pivotally mounted handle.

It is another object to provide a door latch construction of the above noted type which can be operated in a push or pull manner from both sides of the door.

It is still another object of the present invention to provide a push-pull door latch construction in which the handle can be readily oriented to be vertical or horizontal.

It is another object of the present invention to provide a push-pull door latch construction which can accommodate doors of varying thickness.

It is a further object of the present invention to provide a push-pull door latch construction of the above noted type in which major components can be readily fabricated from sheet metal stampings.

It is a general object of the present invention to provide a new and unique push-pull door latch.

Other objects, features, and advantages of the present invention will become apparent from the subsequent description and the appended claims, taken in conjunction with the accompanying drawings, in which:

Figure 1:
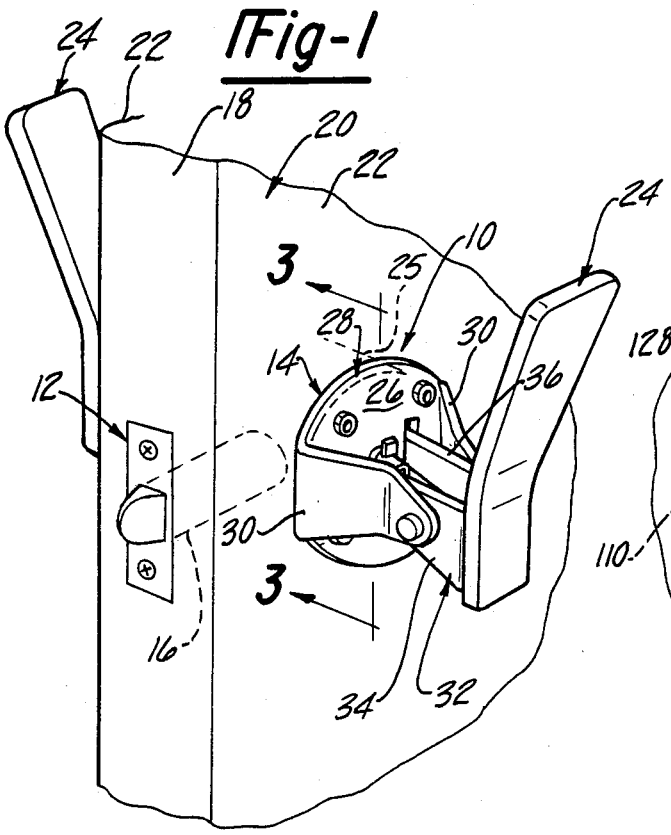
FIG. 1 is a pictorial view of the door latch of the present invention shown in assembly relationship to a door.
Figure 3:
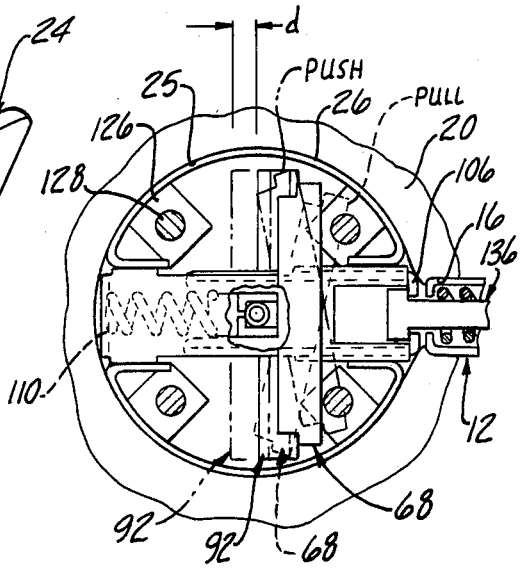
FIG. 3 is a sectional view of the door latch of FIG. 1 taken generally in the direction of the lines 3—3 in FIG. 1.
Figure 4:
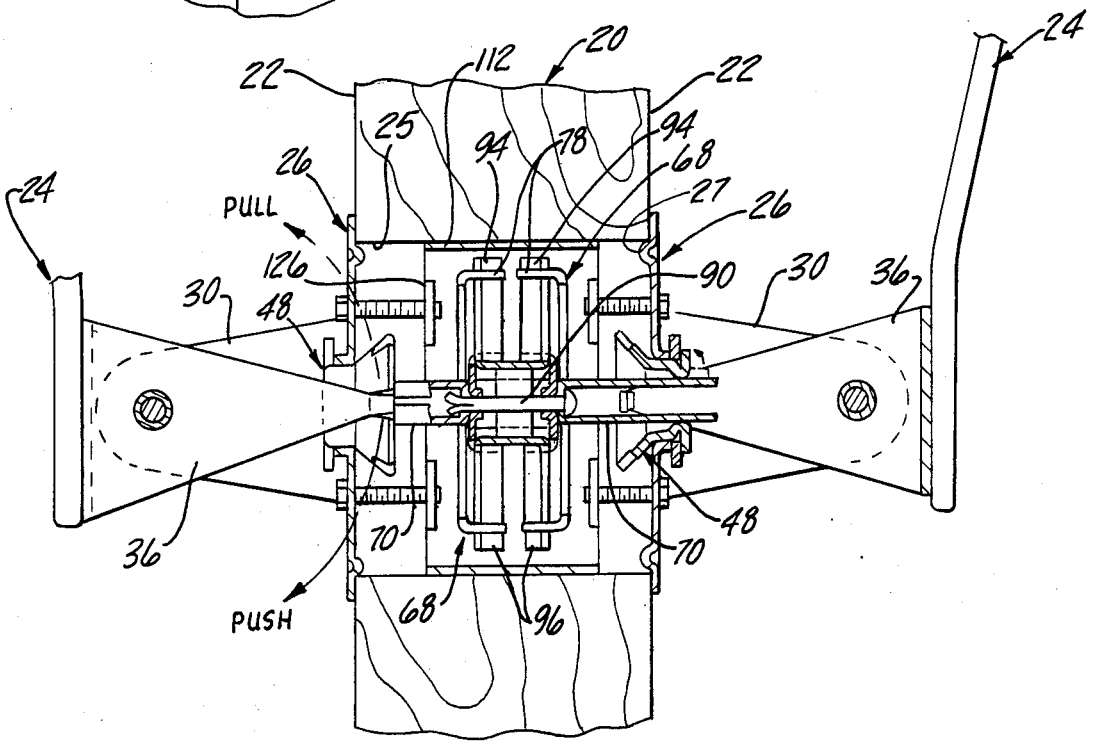
FIG. 4 is a view with some parts shown in section and others broken away of the door latch taken generally along the lines 4—4 in FIG. 1.
Figure 2:
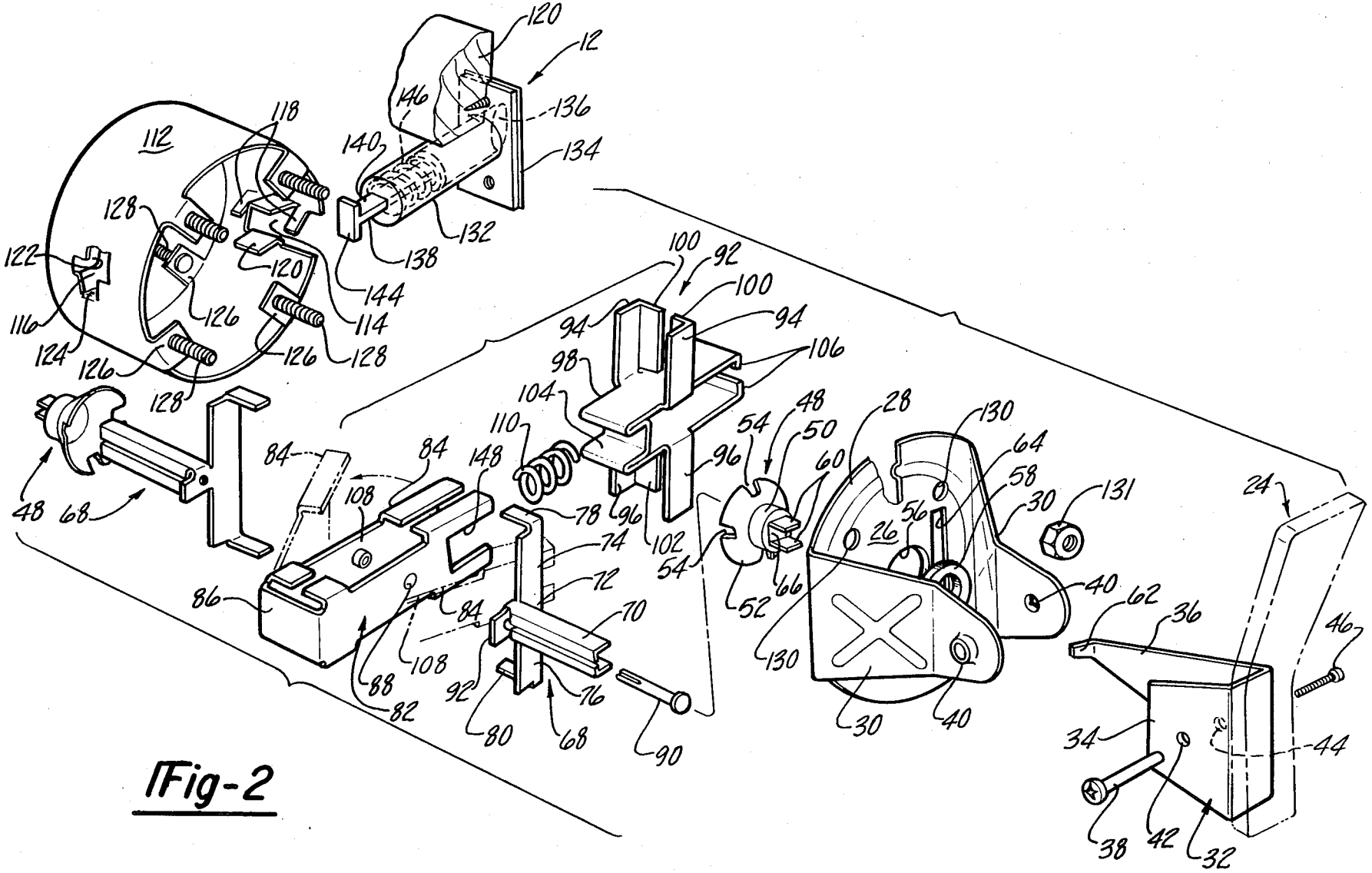
FIG. 2 is an exploded pictorial view of the components of the door latch of FIG. 1; only the right hand handle, handle support, pilot plate and associated members are shown; it should be understood that the left hand components are identical.

Looking now to FIGS. 1 and 2 a door latch assembly 10, embodying features of the present invention is shown in assembly relationship to a door 20. The latch assembly 10 includes a bolt assembly 12 which is actuated by a push-pull latch mechanism 14. The bolt assembly 12 is secured in an opening 16 extending longitudinally through the front edge 18 of the door 20 and inwardly between its opposite sides 22. The latch mechanism 14 is supported in part in a side bore 25 which extends laterally through the opposite sides 22 of the door 20 and which communicates with the door edge opening 16. As will be seen, the latch mechanism 14 is connected with the bolt assembly 12 such as to actuate the bolt assembly between its latched condition and unlatched condition by either pushing or pulling upon an actuating handle 24.

The latch mechanism 14 includes a pair of identical pilot plates 26 which pivotally support the handles 24. Each pilot plate 26 includes a flat plate portion 28 and a pair of outwardly extending, generally spaced flanges 30. The pilot plates 26 are adapted to cover the openings of the lateral or side bore 25 and an annular ridge 27 is adapted to center the pilot plate within such openings. The handles 24 are generally elongated, paddle shaped and are secured to handle supports 32. The handle supports 32 are generally channel shaped and have a short leg 34 and an elongated driver leg 36. An internally threaded pivot pin 38 extends through aligned bores 40 in pilot plate flanges 30 and bores 42 and 44 in handle support legs 34 and 36, respectively. The pivot pin 38 is fastened in place by a bolt 46 which is adapted to threadably engage the internal threads in the pivot pin 38. Thus the pivot pin 38 pivotally supports the handle 24 via the handle support 32 to the pilot plate 26 for pivotal movement towards (pushing) and away from (pulling) the door side 22.

A pinion member 48 has a support ring portion 50 and an enlarged diameter, inwardly dished pinion ring 52. The pinion ring 52 has four radially, equally spaced slots 54 in its periphery. The pinion member 48 has its ring portion 50 rotatably supported in a bore 56 in the flat plate portion 28 of pilot plate 26. A retaining and wear washer 58 also accepts the ring portion 50. A pair of diametrically opposite locking tabs 60 extend axially outwardly from the support ring portion 50 and are bent radially outwardly against the wear washer 58 whereby the pinion member 48 is now axially, laterally retained but rotatably supported to the pilot plate 26.

The elongated driver leg 36 on the handle support 32 terminates in an inwardly bent driver tab 62. The driver tab 62 extends through a slot 64 in the flat plate portion 28 of pilot plate 26 and is adapted to be received within one of the pinion slots 54. With the vertical orientation of the handle 24 as shown, the driver tab 62 will engage the pinion slot 54 which is generally horizontally facing and in line with the plate slot 64. Thus if the handle 24 is pushed towards the door side 22 it will pivot forwardly about the pivot pin 38; the driver leg 36 and associated tab 62 will move downwardly rotating the pinion member 48 in a clockwise direction. If the handle 24 is pulled outwardly it will pivot rearwardly about the pivot pin 38; now the pinion member 48 will rotate in a counter clockwise direction. As will be seen it is this rotary action of pinion member 48 which will result in moving the bolt assembly 12 to its unlatched condition by either pushing or pulling on the handle 24.

The pinion member 48 has a generally rectangular through opening 66. A cam member 68 has a rearwardly extending drive arm 70 having a cross section which complements that of the pinion opening 66 such that it can be slidably received therein. The drive arm 70 is centrally located relative to a cam bar 72 having upwardly and downwardly extending cam arms 74 and 76, respectively, which terminate in laterally extending cam fingers 78 and 80, respectively. Since the cam drive arm 70 is generally matably and drivingly received within the pinion opening 66, the cam fingers 78 and 80 will be rotated by the pinion member 48 and hence by the push or pull action on the handle 24.

The cam member 68 is laterally secured to one side of a generally elongated channel structure defining a guide member 82. The guide member 82 has a pair of generally U-shaped side members 84 which extend generally parallely from an end wall 86. A pair of aligned openings 88 extend through side members 84. A headed split pin 90 extends through an opening in a tab 92 located centrally relative to the cam bar 72 and through the side wall openings 88 and through an opening in a similar tab 92 of the cam member 68 located on the opposite side of guide member 82. Upon assembly, the split ends of the pin 90 will be bent radially outwardly to laterally hold the cam members 68 for pivotal movement on their respective sides of the guide member 82.

The guide 82 is adapted to receive and slidably support a slide member 92. The slide member 92 has a pair of laterally spaced, upwardly extending parallel arms 94 and a pair of laterally spaced, downwardly extending parallel arms 96 which extend from opposite sides of a longitudinally extending central section 98. The upper arms 94 have laterally inwardly extending cam follower flanges 100, while the lower arms 96 have laterally inwardly extending cam follower flanges 102. The rearward end of the central section 98 of slide member 92 is inwardly recessed to define a spring retainer portion 104. A pair of vertically spaced inwardly bent flanges 106 at the forward end of the central section 98 of slide member 92 partially close that end and define a means for gripping a bolt member in a manner to be discussed. A pair of elongated, vertically facing openings 108 are defined by the side members 84 in between the ends of the guide 82.

In assembling the slide member 92 to the guide 82, the guide side members 84 are spread apart as indicated in phantom in FIG. 2. Next the slide member 92 is located in between with a return spring 110 seated in the spring retainer portion 104. In this condition, the guide side members 84 are bent towards each other to the closed position shown. Now the cam members 68 are assembled to the opposite sides of the guide member 82 and the assembly is held together via the pivot pin 90. Note that the spring 110 is in biased engagement with the end wall 86 and will normally urge the slide member 92 forwardly and outwardly from the guide 82. Now the above subassembly can be assembled to an annular support body member 112.

The support body 112 is generally annularly formed to have an outside diameter sufficient to fit within the lateral door opening or bore 25. The support body 112 has a front opening 114 is formed diametrically opposite from a rear opening 116. The front opening has downwardly depending, laterally spaced side retention tabs 118 and also has upper and lower support tabs 120. The rear opening 116 has laterally spaced side retention tabs 122 and upper and lower support tabs 124. The front tabs 118, 120 and rear tabs 122, 124 generally define a rectangular contour similar to the contour of the outside surface of the guide 82 such that the guide 82 can be received within these tabs.

The support body 112 is provided with four radially inwardly bent assembly tabs 126 on each axial side; the tabs 126 are equally radially spaced about the periphery of the support body 112 and each has a generally axially extending threaded stud 128. The pilot plates 26 are provided with four equally, radially spaced holes 130 which are adapted to receive the four associated studs 128. The latter cooperate with threaded nuts 131 to hold the latch mechanism 14 to the door 20 such as to cooperate with the bolt assembly 12 in a manner to be seen.

The bolt assembly 12 includes an elongated hollow housing 132 which terminates at its forward end in a retention plate 134. A bolt 136 is reciprocably mounted within the housing 132 and has a T-shaped rearward end 138 having a stem 140 movable through a similarly shaped rear opening and a cross bar 144 located outside of the housing 132 and outside of the smaller opening which receives the stem 140. A spring 146 is preloaded to normally urge the bolt 136 outwardly from the housing 132 with the cross bar 144 biased towards the confronting end of the housing 132.

With the above description in mind, the method of assembly the latch assembly 10 to the door 12 can be readily understood. First the housing 132 of the bolt assembly 13 is assembled into the door edge opening 16 with the plate 134 fastened via screws in a recessed portion of the door edge 18. Now the subassembly of the annular support body 112, guide 82, slide 92 and cam members 68 is located within the circular side bore 25. In this condition, the guide 82 and slide 92 are positioned in alignment with the bolt assembly 12. The T-shaped end 138 of the bolt 136 is keyed within the slide 92 behind the slide flanges 106. In this regard, enlarged slots 148 at the front end of guide side members 84 provide access to facilitate the latter assembly.

As thus far assembled the slide spring 110 urges the slide 92 to its forwardmost position while the bolt spring 146 urges the bolt 136 outwardly to its latched position. Note that the bolt spring 146 also urges the slide 92 to its forwardmost position. The slide 92 in its forwardmost position will have its upper arms 94 and lower arms 96 in engagement with the upper cam arms 74 and lower cam arms 76. This balanced engagement will hold the cam member 68 and its drive arm 70 in a radially neutral position. This will also hold the actuating handles 24 in a pivotal neutral position. Next the pilot plates 26 with the pinion members 48 rotatably secured thereto are assemblied with the pinion opening 66 matably receiving the cam drive arm 70. The studs 128 are located in the associated plate openings 130 and the assembled parts are secured together via the threaded nuts 131. Next the handle support 32 and associated handles 24 are pivotably connected to the pilot plate flange 30. At the same time the pinion driver tab 62 on driver leg 36 is located within the appropriate one of the pinion slots 54. The assembly is complete and the bolt 136 can be moved to its unlatched position by either pushing or pulling on the handle 24. Of course, when the handle 24 is released, the bolt 136 can reciprocate independently between its unlatched and latched positions via bolt spring 146; thus when the door 12 moves to its closed position, the bolt 136 can automatically reciprocate inwardly and outwardly as it moves past an associated keeper (not shown).

It should be noted that the guide 82 is movable longitudinally within the support body 112; this permits ease of alignment between the pinion member 48 and the cam drive arm 70. Note also that since thedrive arm 70 is axially movable relative to the pinion member 48 within the pinion opening 66 the latch assembly 10 can be used to accommodate doors varying over a wide range of thicknesses depending only upon the length of the drive arm 70.

As shown in the drawings the handle 24 is generally vertically oriented. The handle 24, however, could be just as easily oriented horizontally by simply rotating the pilot plate 26 and its associated parts 90° before assembly of the pinion member 48 onto the cam drive arm 70.

With the construction, as shown, substantially all of the major components can be made from stamped, sheet metal parts. In addition the orientation of parts is simplified since common parts are interchangeable while others are not critical in orientation. Thus the pair of handles 24, handle supports 32, pilot plates 26, pinion members 48 and cam members 68 are identical and interchangeable. The four pinion slots 54 obviate the criticality of radial alignment of the pinion member 48 onto the drive arm 70. The sub-assembly of the guide 82, slide 92, and the cam member 88 can be just as easily assembled with the upper arms 94 down and the lower arms 96 up, etc. All of the above facilitates manufacture and assembly of the door latch of the present invention. Thus a unique push-pull door latch construction has been shown which is versatile in operation and can be manufactured by relatively inexpensive procedures.

While it will be apparent that the preferred embodiments of the invention disclosed are well calculated to fulfill the objects above stated, it will be appreciated that the invention is susceptible to modification, variation and change without departing from the proper scope or fair meaning of the invention.

What is claimed is:

1. In a door having a front edge and a pair of opposite sides and having an edge opening extending through the front edge and between the opposite sides and intersecting a side opening extending laterally through the opposite sides, a handle actuated latch operable in response to either a push action on the handle towards the side of the door or a pull action on the handle away from the side of the door, said door latch comprising:

a bolt assembly adapted to be supported in the door edge opening and including a bolt housing and a bolt supported in said bolt housing for reciprocable movement between a latched position and an unlatched position and further including first spring means for normally biasing said bolt outwardly from the edge opening towards said latched position, an annular support body adapted to be located in the door side opening, said support body having a front opening locatable in line with said bolt assembly in the door edge opening with said front opening being defined by front upper and lower support tabs and side by side laterally spaced front retaining tabs, said support body having a rear opening being defined by upper and lower rear support tabs and side by side laterally spaced rear retaining tabs, a generally elongated channel structure defining a guide member, said guide member adapted to be located within said support body in line with said bolt assembly and having a forward end adapted to be vertically supported between said front support tabs and laterally retained between said front retaining tabs and having a rearward end adapted to be vertically supported between said rear support tabs and laterally supported between said rear retaining tabs, said guide member as supported being movable along the line of said bolt assembly, said guide member having upper and lower enlarged openings generally in line with each other and located between said forward and rearward ends of said guide member, a slide member having an elongated central section adapted to be slidably supported within said guide member, said slide member having a pair of laterally spaced upper cam follower arms extending parallely upwardly from said central section and a pair of laterally spaced lower cam follower arms extending parallely downwardly from said central section, said upper follower arms and said lower follower arms extending upwardly and downwardly, respectively, through said upper and lower enlarged openings of said guide member whereby said slide member can reciprocate within said guide member for at least a portion of the length of said enlarged openings, said central section of said slide member having an indented portion at its rearward extremity for defining a spring seat, a spring member adapted to be located within said spring seat and against the rearward end of said guide member to resiliently urge said slide member towards said bolt assembly, said central section having a pair of spaced flanges defining a laterally extending slot at its forward extremity, said bolt having a generally T-shaped end adapted to be located within said forward end of said central section and to be overengaged by said spaced flanges, a pair of cam members adapted to be pivotally secured to opposite sides of said guide member about an axis extending laterally through said guide member in the area of said enlarged openings, a pivot pin extending through said guide member along said axis for laterally securing said cam members for pivotal movement to said guide member, each of said cam members having an upwardly extending upper cam arm and a downwardly extending lower cam arm, said upper cam arm and said lower cam arm having upper and lower laterally extending cam fingers adapted to selectively engage the associated one of said upper and lower follower arms of said slide member, each of said cam members having a laterally extending drive arm, a pinion member slidably secured to and rotatably engaged with each of said drive arms, said pinion member having a generally annular gear flange defined by four slots in quadrature with each other, a pair of pilot plate members adapted to be secured to opposite sides of the door to generally overlie the associated opening, each of said pilot plate members having a central bore, said pinion member having an annular support portion adapted to be rotatably supported within said central bore, means for laterally securing said pinion to said pilot plate, said pilot plate including a pair of generally parallely extending pilot flanges, a handle support pivotally supported to said pilot plate between said flanges, said pilot plate having an elongated slot, said handle support having an elongated leg extending through said slot and having a driver tab adapted to drivingly engage a selected one of said pinion slots, a handle secured to said handle support and adapted to pivot said driver tab in opposite directions in response to a pulling or pushing action on said handle, said pinion member rotating in opposite directions for a pulling or pulling action on said handle and in turn similarly rotating said drive arm in opposite directions whereby said cam drive arms will be pivoted to drivingly engage either said upper or said lower arms of said slide member depending upon the direction of rotation of said pinion member whereby said slide member will be moved rearwardly in response to such rotation in either direction to move said bolt rearwardly to its unlatched position.

2. In a door having a front edge and a pair of opposite sides and having an edge opening extending through the front edge and between the opposite sides and intersecting a side opening extending laterally through the opposite sides, a handle actuated latch operable in response to either a push action on the handle towards the side of the door or a pull action on the handle away from the side of the door, said door latch comprising:

a bolt assembly adapted to be supported in the door edge opening and including a bolt housing and a bolt supported in said bolt housing for reciprocable movement between a latched position and an unlatched position and further including first spring means for normally biasing said bolt outwardly from the edge opening towards said latched position, an annular support body adapted to be located in the door side opening, said support body having a front opening locatable in line with said bolt assembly in the door edge opening, said support body having front upper and lower support tabs and side by side laterally spaced front retaining tabs, said support body having upper and lower rear support tabs and side by side laterally spaced rear retaining tabs, a generally elongated channel structure defining a guide member, said guide member adapted to be located within said support body in line with said bolt assembly and having a forward end adapted to be vertically supported between said front support tabs and laterally retained between said front retaining tabs and having a rearward end adapted to be vertically supported between said rear support tabs and laterlly supported between said rear retaining tabs, said guide member as supported being movable along the line of said bolt assembly, said guide member having upper and lower enlarged openings generally in line with each other and located between said forward and rearward ends of said guide member, a slide member having an elongated central section adapted to be slidably supported within said guide member, said slide member having a pair of laterally spaced upper cam follower arms extending parallely upwardly from said central section and a pair of laterally spaced lower cam follower arms extending parallely downwardly from said central section, said upper follower arms and said lower follower arms extending upwardly and downwardly, respectively, through said upper and lower enlarged openings of said guide member whereby said slide member can reciprocate within said guide member for at least a portion of the length of said enlarged openings, second spring means operative between said slide member and said guide member to resiliently urge said slide member towards said bolt assembly, said central section having a pair of spaced flanges defining a laterally extending slot at its forward extremity, said bolt having a generally T-shaped end adapted to be located within said forward end of said central section and to be overengaged by said spaced flanges, a pair of cam members adapted to be pivotally secured to opposite sides of said guide member about an axis extending laterally through said guide member in the area of said enlarged openings, pivot means for laterally securing said cam members for pivotal movement to said guide member about said axis, each of said cam members having an upwardly extending upper cam arm and a downwardly extending lower cam arm, said upper cam arm and said lower cam arm having upper and lower cam surfaces adapted to selectively engage the associated one of said upper and lower follower arms of said slide member, each of said cam members having a laterally extending drive arm, a pinion member slidably secured to and rotatably engaged with each of said drive arms, said pinion member having a generally annular gear flange defined by at least one drive slot, a pair of pilot plate members adapted to be secured to opposite sides of the door to generally overlie the associated opening, each of said pilot plate members having a central bore, said pinion member having an annular support portion adapted to be rotatably supported within said central bore, means for laterally securing said pinion to said pilot plate, said pilot plate including a pair of spaced pilot flanges, a handle support pivotally supported to said pilot plate between said flanges, said pilot plate having an elongated slot, said handle support having an elongated leg extending through said slot and having a driver tab adapted to drivingly engage said pinion slot, a handle secured to said handle support and adapted to pivot said driver tab in opposite directions in response to a pulling or pushing action on said handle, said pinion member rotating in opposite directions for a pulling or pulling action on said handle and in turn similarly rotating said drive arm in opposite directions whereby said cam drive arms will be pivoted to drivingly engage either said upper or said lower arms of said slide member depending upon the direction of rotation of said pinion member whereby said slide member will be moved rearwardly in response to such rotation in either direction to move said bolt rearwardly to its unlatched position.

3. In a door having a front edge and a pair of opposite sides and having an edge opening extending through the front edge and between the opposite sides and intersecting a side opening extending laterally through the opposite sides, a latch operable in response to either a push action on a handle structure towards the side of the door or a pull action on the handle structure away from the side of the door, said door latch comprising:

a bolt assembly adapted to be supported in the door edge opening and including a bolt housing and a bolt supported in said bolt housing for reciprocable movement between a latched position and an unlatched position and spring means for normally biasing said bolt outwardly from the edge opening towards said latched position, an annular support body adapted to be located in the door side opening, said support body having a front opening locatable in line with said bolt assembly in the door edge opening, a generally elongated channel structure defining a guide member, support means supporting said guide member within said support body in line with said bolt assembly, said guide member as supported being movable along the line of said bolt assembly, said guide member having upper and lower openings generally in line with each other and located between its opposite ends, a slide member having a central section adapted to be slidably supported within said guide member, said slide member having an upper cam follower arm extending upwardly from said central section and a lower cam follower arm extending downwardly from said central section, said upper follower arm and said lower follower arm extending upwardly and downwardly, respectively, through said upper and lower openings of said guide member whereby said slide member can reciprocate within said guide member for at least a portion of the length of said openings, said spring means resiliently urging said slide member towards said bolt assembly, said central section having a bolt opening at its forward extremity, said bolt having an end portion adapted to be located within said forward end of said central section and to be overengaged within said bolt opening, a cam member adapted to be pivotally secured to said guide member about a laterally extending axis, pivot means for laterally securing said cam member for pivotal movement to said guide member about said axis, said cam member having an upwardly extending upper cam arm and a downwardly extending lower cam arm, said upper cam arm and said lower cam arm having upper and lower cam surfaces adapted to selectively engage the associated one of said upper and lower follower arms of said slide member, said cam member having a laterally extending drive arm, a pinion member slidably secured to and rotatably engaged with said drive arm, said pinion member having a gear portion, a pilot plate member adapted to be secured to the slide of the door to generally overlie the associated opening, said pinon member having an annular support portion adapted to be rotatably supported on said pilot plate, a handle structure pivotally supported to said pilot plate, said handle structure having a driver leg adapted to drivingly engage said gear portion of said pinion member, said handle structure adapted to pivot said driver leg in opposite directions in response to a pulling or pushing action on said handle structure, said pinion member rotating in opposite directions for a pulling or pulling action on said handle structure and in turn similarly rotating said dirve arm in opposite directions whereby said cam drive arms will be pivoted to drivingly engage either said upper or said lower arms of said slide member depending upon the direction of rotation of said pinion member whereby said slide member will be moved rearwardly in response to such rotation in either direction to move said bolt rearwardly to its unlatched position.

4. In a door having a front edge and a pair of opposite sides and having an edge opening extending through the front edge and between the opposite sides and intersecting a side opening extending laterally through the side of the door, a latch operable in response to either a push action on a handle structure towards the side of the door or a pull action on the handle structure away from the side of the door, said door latch comprising:

a bolt assembly adapted to be supported in the door edge opening and including a bolt housing and a bolt supported in said bolt housing for reciprocable movement between a latched position and an unlatched position and spring means for normally biasing said bolt outwardly from the edge opening towards said latched position, a guide member, guide support means for supporting said guide member in the door side opening in line with said bolt assembly, a slide member having a central section adapted to be slidably supported by said guide member, said slide member having an upper cam follower arm extending upwardly from said central section and a lower cam follower arm extending downwardly from said central section, said spring means resiliently urging said slide member towards said bolt assembly, bolt receiving means on said central section for receiving said bolt and permitting said bolt to move longitudinally relative to said central section, a cam member, pivot means for laterally securing said cam member for pivotal movement about a laterally extending axis, said cam member having an upwardly extending upper cam arm and a downwardly extending lower cam arm, drive arm means engaged with said cam member for pivoting said cam member about said lateral axis, a pinion member rotatably, drivingly engaged with said drive arm means, said pinion member having a gear portion, pinion support means for supporting said pinion member for rotation, a handle structure, pivot means for pivotally supporting said handle structure for pivotal movement towards or away from the associated side of the door, said handle structure having a driver member adapted to drivingly engage said gear portion of said pinion member, said handle structure adapted to pivot said driver member in opposite directions in response to a pulling or pushing action on said handle structure, said pinion member rotating in opposite directions for a pulling or pulling action on said handle structure and in turn similarly rotating said drive arm means in opposite directions whereby said cam drive arms will be pivoted to drivingly engage either said upper or said lower arms of said slide member depending upon the direction of rotation of said pinion member whereby said slide member will be moved rearwardly in response to such rotation in either direction to move said bolt rearwardly to its unlatched position.

5. The door latch of claim 4 with said guide support means supporting said guide member for movement along the line of said bolt assembly.

6. The door latch of claim 4 with said pinion being slidably supported on said drive arm means.

7. The door latch of claim 4 further comprising a pilot plate member adapted to be secured to the side of the door to generally overlie the associated opening, said pinion support means rotatably supporting said pinion member to said pilot plate member.

8. The door latch of claim 4 further comprising a pilot plate member adapted to be secured to the side of the door to generally overlie the associated opening, said pivot means supporting said handle structure to said pilot plate member for pivotal movement towards or away from the associated side of the door.

9. The door latch of claim 8 with said pinion support means rotatably supporting said pinion member to said pilot plate member.

10. The door latch of claim 9 with said pinion being slidably supported on said drive arm means.

11. The door latch of claim 10 with said guide support means supporting said guide member for movement along the line of said bolt assembly.

12. The door latch of claim 4 further comprising a pilot plate member adapted to be secured to the side of the door to generally overlie the associated opening, said pivot means supporting said handle structure to said pilot plate member for pivotal movement towards or away from the associated side of the door, said pilot plate member having a generally annularly extending ridge adapted to center said pilot plate within said associated opening.

13. In a door having a front edge and a pair of opposite sides and having an edge opening extending through the front edge and between the opposite sides and intersecting a side opening extending laterally through the side of the door, a latch operable in response to either a push action on a handle structure towards the side of the door or a pull action on the handle structure away from the side of the door, said door latch comprising:

a bolt assembly adapted to be supported in the door edge opening and including a bolt housing and a bolt supported in said bolt housing for reciprocable movement along an axis between a latched position and an unlatched position, a slide member having a central section, slide support means for supporting said slide member for reciprocal movement along said bolt axis, said slide member having an upper cam follower arm extending upwardly from said central section and a lower cam follower arm extending downwardly from said central section, bolt receiving means on said central section for receiving said bolt and permitting said bolt to move longitudinally relative to said central section, a cam member, pivot means for laterally securing said cam member for pivotal movement about a laterally extending axis, said cam member having an upwardly extending upper cam arm and a downwardly extending lower cam arm adapted to selectively engage the associated one of said upper and lower follower arms of said slide member, drive arm means engaged with said cam member for pivoting said cam member about said lateral axis, a pinion member rotatably, drivingly engaged with said drive arm means, said pinion member having a gear portion, pinion support means for supporting said pinion member for rotation, a handle structure, pivot means for pivotally supporting said handle structure for pivotal movement towards or away from the associated side of the door, said handle structure having a driver member adapted to drivingly engage said gear portion of said pinion member, said handle structure adapted to pivot said driver member in opposite directions in response to a pulling or pushing action on said handle structure, said pinion member rotating in opposite directions for a pulling or pulling action on said handle structure and in turn similarly rotating said drive arm means in opposite directions whereby said cam drive arms will be pivoted to drivingly engage either said upper or said lower arms of said slide member depending upon the direction of rotation of said pinion member whereby said slide member will be move rearwardly in response to such rotation in either direction to move said bolt rearwardly to its unlatched position.

14. In a door having a front edge and a pair of opposite sides and having an edge opening extending through the front edge and between the opposite sides and intersecting a side opening extending laterally through the side of the door, a latch operable in response to either a push action on a handle structre towards the side of the door or a pull action on the handle structure away from the side of the door, said door latch comprising:

a bolt assembly adapted to be supported in the door edge opening and including a bolt housing and a bolt supported in said bolt housing for reciprocable movement along an axis between a latched position and an unlatched position, a slide member having a central section, slide support means for supporting said slide member for reciprocal movement along said bolt axis, said slide member having an upper cam follower arm extending upwardly from said central section and a lower cam follower arm extending downwardly from said central section, bolt engaging means on said central section for engaging said bolt and for moving said bolt along said bolt axis, a cam member, pivot means for laterally securing said cam member for pivotal movement about a laterally extending axis, said cam member having an upwardly extending upper cam arm and a downwardly extending lower cam arm adapted to selectively engage the associated one of said upper and lower follower arms of said slide member, drive arm means engaged with said cam member for pivoting said cam member about said lateral axis, a pinion member rotatably, drivingly engaged with said drive arm means, said pinion member having a gear portion, pinion support means for supporting said pinion member for rotation, a handle structure, pivot means for pivotally supporting said handle structure for pivotal movement towards or away from the associated side of the door, said handle structure having a driver member adapted to drivingly engage said gear portion of said pinion member, said handle structure adapted to pivot said driver member in opposite directions in response to a pulling or pushing action on said handle structure, said pinion member rotating in opposite directions for a pulling or pulling action on said handle structure and in turn similarly rotating said drive arm means in opposite directions whereby said cam arms will be pivoted to drivingly engage either said upper or said lower arms of said slide member depending upon the direction of rotation of said pinion member whereby said slide member will be moved rearwardly in response to such rotation in either direction to move said bolt rearwardly to its unlatched position.

* * * * *